United States Patent [19]

Nebzydoski et al.

[11] 3,952,059

[45] Apr. 20, 1976

[54] ALKYL AMMONIUM THIOCYANATE MANUFACTURE AND LUBE CONTAINING SAME

[75] Inventors: John W. Nebzydoski, Fishkill; Harry Brockway, Beacon; Edwin L. Patmore, Fishkill; Frederick G. Oberender, Wappingers Falls, all of N.Y.

[73] Assignee: Texaco Inc., New York, N.Y.

[22] Filed: Sept. 9, 1974

[21] Appl. No.: 504,635

Related U.S. Application Data

[62] Division of Ser. No. 329,505, Feb. 5, 1973, Pat. No. 3,867,297.

[52] U.S. Cl. ..... 260/583 R; 252/47; 252/47.5; 260/501.1; 260/583 K; 260/583 P

[51] Int. Cl.[2] ..... C07C 87/04; C07C 87/14

[58] Field of Search ..... 260/583 R, 583 P, 501.1, 260/583 EE; 252/47.5

[56] References Cited

UNITED STATES PATENTS

| | | | |
|---|---|---|---|
| 2,362,890 | 11/1944 | Dietrich | 252/47 |
| 2,483,415 | 10/1949 | Hill | 260/583 R |
| 3,330,763 | 7/1967 | Damrath | 252/47.5 |
| 3,789,075 | 1/1974 | Dundy | 252/47.5 |

*Primary Examiner*—Arthur P. Demers
*Attorney, Agent, or Firm*—T. H. Whaley; C. G. Ries; Robert A. Kulason

[57] ABSTRACT

A method of producing an alkyl amine salt of thiocyanic acid having enhanced load-carrying properties when employed in synthetic ester lubricating oils comprising contacting an alkyl amine with ammonium thiocyanate or monoalkyl ammonium thiocyanate at an elevated temperature while continuously blowing the reaction mixture with an oxygen containing gas and recovering the formed alkyl ammonium thiocyanate salt, the oxygen containing gas being introduced into the reaction mixture in a total amount of between about 0.2 and 5.0 moles per equivalent weight of amine; and synthetic ester oil compositions containing a load-carrying additive amount of the alkyl ammonium thiocyanate prepared by said method.

3 Claims, No Drawings

ALKYL AMMONIUM THIOCYANATE MANUFACTURE AND LUBE CONTAINING SAME

This is a division of application Ser. No. 329,505, filed Feb. 5, 1973, now U.S. Pat. No. 3,867,297.

BACKGROUND OF INVENTION

Hereinbefore and hereinafter the terms alkyl ammonium thiocyanate and alkyl amine encompass alkylene diammonium dithiocyanates and alkylene diamines respectively as well as their monothiocyanate and monoamine counterparts.

In the lubricating oil field such as in the area of gear oils, transmission fluids, marine oils and, particularly, in gas turbine engine oils, extensive efforts are being made to develop lubricating oil compositions of ever-increasing load-carrying ability without sacrificing wear, corrosion resistance and oxidation resistance. One class of materials found to impart improved load-carrying properties, that is, extreme pressure (EP) properties to lubricating oil compositions without detrimentally affecting other properties are the hydrocarbyl amine salts of thiocyanic acid. These salts and their use in lubricating compositions as load-carrying improvement additives are described in U.S. Pat. No. 3,330,763. Although the amine thiocyanates described therein are effective EP improving agents, there is a continuing search due to the high load demands on modern day lubricant oils to further improve the effectiveness of these salts. One means would be to utilize the amine thiocyanate in conjunction with a second additive substance which would result in a synergistic enhancement of the load-carrying properties of the thiocyanate salt as described in coassigned copending applications, Ser. No. 160,192, filed July 6, 1971 now U.S. Pat. No. 3,756,952 and Ser. No. 190,310, filed Oct. 18, 1971, now U.S. Pat. No. 3,767,573. However, in view of the fact the high additive contents in lubricating oils are today reaching a point which is adversely affecting the lubricating properties of the oils and the more additive materials and quantities introduced into the lubricant oils the greater the cost, there is a need for an alternative means of enhancing the load-carrying properties of the alkyl ammonium thiocyanate additive per unit additive weight.

SUMMARY OF INVENTION

We have discovered and this constitutes one embodiment of our invention that in the manufacture of alkyl ammonium thiocyanate via contacting an alkyl amine with a thiocyanate reactant, the continual introduction of an oxygen containing gas into the reaction mixture unexpectedly enhances the load-carrying (EP) properties in lubricating oils of the formed thiocyanate salt. Another embodiment of the invention pertains to synthetic ester lubricating oil compositions containing the alkyl ammonium thiocyanate salts prepared via the method of the first embodiment.

DETAILED DESCRIPTION OF THE INVENTION

More specifically, the alkyl ammonium thiocyanates of enhanced load-carrying ability often characterized by the formula:

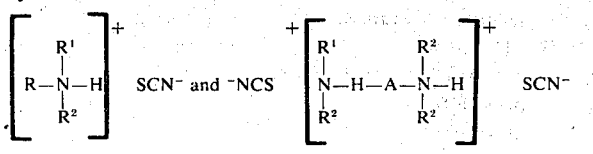

are prepared by the method comprising forming a mixture of alkyl amine selected from the group consisting of

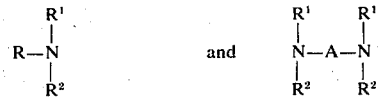

where R is alkyl of from 6 to 30 carbons, $R^1$ and $R^2$ are hydrogen or alkyl of from 1 to 10 carbons and A is alkylene of from 2 to 4 carbons and thiocyanate reactant of the formula MSCN where M is a monovalent radical selected from the group consisting of ammonium and monoalkyl ammonium of from 2 to 7 carbons in a ratio of equivalent weight of amine to mole of thiocyanate reactant of between about 1:1.2 and 0.9:1, preferably between 1:1.05 and 1.1, heating and maintaining the resultant mixture at a temperature between 90° and 130°C., preferably between 105° and 115°C., while continuously and simultaneously passing any oxygen containing gas therethrough in a mole ratio of oxygen to initial amine equivalent weight of between about 5:1 and 0.2:1, preferably between 2:1 and 0.5:1, advantageously utilizing an oxygen containing gas rate of between about 40 and 200 volumes, preferably between 50 and 100 volumes per volume reaction mixture per hour. The reaction is continued until at least a substantial portion if not all the reactants have been consumed. This takes place usually in a period of between about 2 and 24 hours. When ammonium thiocyanate, the preferred thiocyanate reactant, is employed the heating and oxygen gas blowing is continued until there is essentially no odor of ammonia by-product.

At the end of the reaction, the product may be purified, if desired, by standard means such as by diluting with a volatile inert solvent, e.g., heptane, utilizing a solvent quantity of between about 0.5 and 3.0 volume per volume reaction mixture and adding filter aid, e.g., between about 10 and 40 wt. % basis the reaction mixture, filtering the resultant product, followed by distilling off the volatile solvent, and recovering the purified alkyl ammonium thiocyanate product as residue.

To facilitate contact of the thiocyanate reactant, alkyl amine and oxygen containing gas, inert diluent may be employed advantageously in amounts of between about 20 and 100 wt. % of the reaction mixture. An example of suitable inert diluent is alkanol of from 1 to 6 carbons such as methanol, ethanol, isopropanol, propanol and isobutanol.

To further facilitate ingredient contact, agitation of the reaction mixture is desirable. Usually the passage of the oxygen containing gas through the reaction mixture is sufficient, however, supplemental agitation can be employed, if necessary, such as stirring.

Specific examples of the amine reactants include hexyl amine, octyl amine, lauryl amine, octadecyl amine, 2-ethylhexyl amine, eicosyl amine, tricosyl amine, dimethyl-2-ethylhexyl amine, di-t-octyl ethylene diamine and dipentyl-1,4-butylene diamine. The preferred amines are the primary monoamines in which the alkyl group is tertiary alkyl having 10 to 24 carbons. Particularly preferred amines are certain commercially available mixtures of tertiary monoalkyl primary amines. One of these preferred tertiary primary alkyl amine mixtures is one in which the alkyl moieties are of from 11 to 14 carbons and is known as Primene 81-R. Another preferred mixture of tertiary alkyl primary amines are those where the alkyl moieties are of 18 to 24 carbons and is known as Primene JM-T.

Examples of the thiocyanate reactants contemplated herein are ammonium thiocyanate, methyl ammonium thiocyanate, ethyl ammonium thiocyanate and hexyl ammonium thiocyanate.

Examples of the oxygen containing gas are air, oxygen synthetic mixtures of oxygen and an inert gas such as between about 10 and 90 volume % inert gas, e.g., nitrogen.

Examples of the formed alkyl amine thiocyanate salts contemplated herein are t-$C_{11}$–$C_{14}$ alkyl ammonium thiocyanate, t-$C_{18}$–$C_{24}$ alkyl ammonium thiocyanate, octyl ammonium thiocyanate, 2-ethylhexyl ammonium thiocyanate, eicosyl ammonium thiocyanate, dibutyl octyl ammonium thiocyanate, N,N'-di(t-octyl)-1,2-ethane diammonium dithiocyanate, N,N'-di(t-$C_{18}$–$C_{22}$ alkyl)-1,4-butane diammonium dithiocyanate, dimethyl-2-ethylhexyl ammonium thiocyanate and di-t-octyl ammonium thiocyanate.

The mechanism of how the oxygen gas blowing of the reaction mixture enhances load-carrying properties to the amine thiocyanate product is not presently understood. It is to be noted analysis results of representative amine thiocyanate salts resulting from oxygen gas blown reaction mixture and analysis results of non oxygen blown corresponding salts in respect to infrared and ultraviolet spectra, nitrogen and sulfur contents and neutralization number (Neut. No.) are essentially the same. This latter fact demonstrates the unexpectedness of the discovery of improved load-carrying ability by oxygen blowing via the method contemplated herein.

In respect to the compositions of the invention, they comprise a synthetic ester base oil containing the improved thiocyanate additive product prepared by the method of the invention, said additive present in an amount sufficient to increase the load-carrying ability of the base oils. Appropriate additive concentrations are generally in the range of from about 0.01 to about 5 wt. %, preferably between 0.05 to 3 wt. % of the final lubricating mixture. Lower amounts may be used, but the results increase in EP properties is generally insufficient to justify addition of the thiocyanate. Higher amounts are also operable but may cause ancillary problems such as corrosion.

The base fluid component of the lubricant of the invention is an ester-base fluid prepared from a pentaerythritol or trimethylolpropane and a mixture of hydrocarbyl monocarboxylic acids. It is understood that the pentaerythritol class includes the polypentaerythritols, such as dipentaerythritol, tripentaerythritol and tetrapentaerythritol as suitable components of the ester base oil.

The hydrocarbon monocarboxylic acids which are used to form the ester-base fluid include the straight-chain and branched-chain aliphatic acids, cycloaliphatic acids and aromatic acids as well as mixtures of these acids. The acids employed have from about 2 to 18 carbon atoms per molecule, the preferred members having from 5 to 10 carbon atoms. Examples of suitable acids are acetic, propionic, butyric, valeric, isovaleric, caproic, decanoic, cyclohexanoic, naphthenic, benzoic acid, phenylacetic, tertiary-butylacetic acid and 2-ethylhexanoic acid.

In general, the acids are reacted in proportions leading to a completely esterified pentaerythritol or trimethylolpropane with the preferred ester bases being the pentaerythritol tetraesters. Examples of commerically available tetraesters include pentaerythritol tetracaproate, which is prepared from purified pentaerythritol and crude caproic acid containing other $C_5$–$C_{10}$ monobasic acids. Another suitable tetraester is prepared from a technical grade pentaerythritol and a mixture of acids comprising 38 wt. % valeric, 13 wt. % 2-methyl pentanoic, 32 wt. % octanoic and 17 wt. % pelargonic acids. Another effective ester is the triester of trimethylolpropane in which the trimethylolpropane is esterified with a monobasic acid mixture consisting of 2 wt. % valeric, 9 wt. % caproic, 13 wt. % heptanoic, 7 wt. % octanoic, 3 wt. % caprylic, 65 wt. % pelargonic and 1 wt. % capric acids. Trimethylolpropane triheptanoate, tromethylolpropane tripentanoate and trimethylolpropane trihexanoate are also suitable ester bases.

Further examples of the base oils contemplated herein are pentaerythritol tetrabutyrate, pentaerythritol tetravalerate, pentaerythritol butyrate caproate divalerate, pentaerythritol butyrate, pentaerythritol butyrate tricaproate, pentaerythritol tributyrate caproate, mixed $C_4$–$C_{10}$ saturated fatty acids of pentaerythritol, dipentaerythritol hexavalerate, dipentaerythritol hexacaproate, dipentaerythritol hexaheptoate, dipentaerythritol hexacaproate, dipentaerythritol tributyrate tricaproate, dipentaerythritol trivalerate trinonylate, dipentaerythritol mixed hexaesters of $C_4$–$C_{10}$ fatty acids and trimethylolpropane heptylate.

The ester base oils comprise the major portion of the fully formulated synthetic ester base lubricating oil composition. The ester base normally constitutes at least 90 wt. % of the lubricating oil composition and generally will comprise from about 90 to 98 wt. % of the lubricant.

In the finished lubricating oil compositions contemplated herein supplementary additives are usually included such as metal deactivators, antioxidants, anti-wear agents, antifoamants, VI improvers and supplementary load-carrying improving agents.

Typical examples of antioxidants which may be employed are the alkaryl and diaryl amines such as di-t-octyldiphenyl amine, N-(4-cumylphenyl)-6-cumyl-2-naphthylamine, phenyl-alpha-naphthylamine, phenyl-beta-naphthylamine, phenothiazine, etc. The antioxidants are usually present in an amount from about 0.2 to about 5 wt. % of the final composition.

Metal deactivators which may be employed are quinizarin, 1,4-dihydroxyanthraquinone, 1,5-dihydroxyanthaquinone, 1,2,4-trihydroxyanthraquinone, and 1,2,5,8-tetrahydroxyanthraquinone, etc. Metal deactivators are normally employed in amounts between about 0.04 and 2.0 wt. %.

Anti-wear agents which may be utilized are tricresyl phosphate, triphenyl phosphate, triphenyl phosphate, cresyl diphenyl phosphate, tri(2-ethylhexyl)-phosphate, tributyl phosphate, etc. These anti-wear agents are normally utilized in amounts of between about 0.5 and 5.0 wt. % of the final composition.

Antifoamants which can be employed are the silicone polymers such as dimethyl silicone polymers in amounts of between about 10 and 1000 ppm.

In regard to VI improvers, one widely used class of VI improvers are the acrylate and methacrylate polymers of monohydric alcohols of from 1 to 30 carbons of a molecular weight of between about 100,000 and 10,000,000. For example, the tetrapolymer of butyl methacrylate, dodecyl methacrylate, octadecyl methacrylate and dimethylaminoethyl methacrylate in a weight ratio of 4/10/5/1 and the tripolymer of butyl, dodecyl and octadecyl methacrylates.

One of the preferred lubricant composition embodiments of the invention encompasses the combination of amine thiocyanate product contemplated herein in an amount of 0.01 to 2.5 wt. % in combination with 0.04 to 2.0 wt. % of a polyhydroxy-substituted anthraquinone represented by the formula:

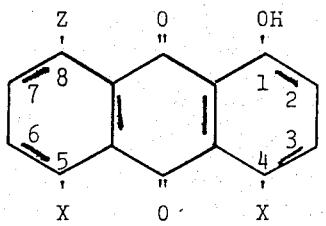

in which X, Y and Z each represent hydrogen or a hydroxyl group and at least one of these is a hydroxyl group. This combination results in a synergistic increase in load-carrying ability.

Examples of the anthraquinone load improving supplements contemplated herein include 1,4-dihydroxy anthraquinone (quinizarin), 1,5-dihydroxy anthraquinone 1,2,4-trihydroxyanthraquinone and 1,2,5,8-tetrahydroxyanthraquinone.

The following examples illustrate the method and compositions of the invention. The abbreviation TBN used therein refers to total base number.

EXAMPLE I

This example illustrates the method of the invention and the improved alkyl ammonium thiocyanate product resulting therefrom.

To a three-necked flask fitted with a thermometer, stirrer, condenser, gas inlet and exit tubes there was charged 75 grams (0.24 mole) of Primene JM-T (TBN 177) and 18.1 grams (0.24 mole) of ammonium thiocyanate. The stirrer and air blowing of the mixture at a rate of 10 liter per hour were initiated and the reaction mixture was heated to and maintained at 110°C. until the evolution of ammonia ceased (13 hours). At the end of the 13 hour reaction period, air blowing and stirring were terminated. The reaction mixture was cooled to room temperature, diluted with 150 mls. of heptane and 20 grams of inert amorphous silica filter aid were added to the mixture. The mixture was heated to reflux (98°C.), cooled, filtered through filter aid and subjected to concentration under a reduced pressure of 30 mm Hg. to 100°C. to afford a 70 gram residual product identified as Primene JM-T ammonium thiocyanate having a Neut. No. of 151 (calc. 150), a nitrogen content of 7.7 wt. % (calc. 7.5) and a sulfur content of 8.9 (calc. 8.6).

EXAMPLE II

This example further illustrates the method of the invention and the improved alkyl ammonium thiocyanate product prepared therefrom.

To a three-necked flask as described in Example I there was charged 38.2 (0.2 mole) grams of Primene 81-R (TBN 246) and 15.2 (0.21 mole) grams of ammonium thiocycanate. Stirring and the blowing of the reaction mixture with air at a rate of 1 liter per hour as initiated and the reaction mixture was heated to and maintained at 110°C. until the evolution of ammonia ceased (10 hours). It was calculated that a total of 0.5 moles of oxygen per mole of initial amine were introduced into the reaction mixture. The reaction mixture was cooled, diluted with 100 mls. of heptane and 10 grams of inert amorphous silica filter aid were added. The mixture was heated to reflux, cooled, filtered through filter paper and concentrated under reduced pressure of 10–20 mm Hg. to 100°C. to afford 45.5 grams of product identified as the Primene 81-R ammonium thiocyanate having a Neut. No. of 211 (calc. 219), a nitrogen content of 11.7 wt. % (calc. 11.3) and a sulfur content of 12.7 (calc. 12.8).

EXAMPLE III

This example further illustrates the method of the invention and the improved alkyl ammonium thiocyanate.

To a three-necked flask as described in Example I there was charged 38.7 grams (0.3 mole) of t-octylamine and 22.8 grams (0.3 mole) of ammonium thiocyanate. Stirring and air blowing at a rate of 1 liter per hour was initiated and the reaction mixture was heated to and maintained at 100°C. for an 8 hour period as air was bubbled through the stirred reactants. It was calculated a total of 0.25 mole of oxygen per mole of initial amine was introduced into the reaction mixture. At the end of the 8 hour period the evolution of ammonia had ceased and the reaction mixture was cooled to room temperature, slurried with 0.1 liter of heptane, and the solid product was filtered off to yield 53.1 grams of product identified as the t-octyl ammonium thiocyanate having a Neut. No. of 285 (calc. 300), a nitrogen content of 15.1 wt. % (calc. 14.9) and a sulfur content of 16.5 wt. % (calc. 17.0 wt. %).

EXAMPLE IV

This example sets forth a comparative procedure utilizing nitrogen blowing rather than oxygen blowing to produce an alkyl ammonium thiocyanate product which will be subsequently demonstrated (Example VIII) as inferior in respect to load-carrying properties in lubricating oil to the corresponding representative product of Example I.

To the apparatus as described in Example I there was charged 18.1 (0.26 mole) grams of ammonium thiocyanate and 75 (0.24 mole) of Primene JM-T. The stirrer and nitrogen gas blowing of the reaction mixture at a rate of 2 liters per hour were initiated and the reaction mixture was heated to and maintained at 110°C. with continued stirring and nitrogen blowing until the evolution of ammonia ceased (16 hours). At the end of the 16 hour period the stirring and nitrogen blowing was ceased and the reaction mixture was cooled, diluted with 150 mls. of heptane and 15 grams of inert amorphous silica filter aid was added. The resultant mixture was warmed to reflux (95°C.) with stirring, cooled to room temperature and filtered through paper. The filtrate was concentrated under reduced pressure (105°C. at 20 mm Hg, and then at 5 mm Hg.) to form 68.5 grams of residue determined to be Primene JM-T ammonium thiocyanate having a Neut. No. of 148

(calc. 150), a nitrogen content of 7.2 wt. % (calc. 7.5 wt. %) and a sulfur content of 8.7 wt. % (calc. 8.6 wt. %).

EXAMPLE V

This is a comparative procedure to demonstrate the production of an alkyl ammonium thiocyanate product of inferior load-carrying properties (See Example VIII) in comparison to representative corresponding product of Example II.

To an apparatus as described in Example I there was charged 38.2 grams (0.2 mole) of Primene 81-R (TBN 246) and 15.5 grams (0.22 mole) of ammonium thiocyanate. Stirring and nitrogen blowing at a rate of 2 liters per hour were initiated and the temperature was increased to and maintained at 110°C. with stirring and nitrogen purging continued until the evolution of ammonia ceased (8 hours). The reaction mixture was cooled, diluted with heptane and inert amorphous silica filter aid was added to the mixture. The mixture was heated to reflux (95°C.), cooled to room temperature, filtered through paper and concentrated under reduced pressure (100°C. at 20 mm Hg). to afford a viscous oil residue. The viscous oil was identified as the Primene 81-R ammonium thiocyanate having a Neut. No. of 224 (calc. 219), a sulfur content of 12.9 wt. % (calc. 12.8 wt. %) and a nitrogen content of 11.6 wt. % (calc. 11.3 wt. %).

EXAMPLE VI

This example is directed to a comparative procedure for producing alkyl ammonium thiocyanate in which the oxygen containing gas blowing takes place after rather than during the preparation of the ammonium thiocyanate product. It is subsequently demonstrated in Example VIII the resultant thiocyanate product is of inferior load-carrying capacity in lubricating oil as opposed to the corresponding product of Examples I and II prepared by the method of the invention.

To a 1000 mls. three-necked flask as described in Example I there was charged 76 grams (1 mole) of ammonium thiocyanate and 315 grams (1.1 mole) of Primene JM-T (TBN 177). As a stream of nitrogen was bubbled through (30 mls./minute) the stirred reaction mixture, the temperature was gradually raised to 110°C. (230°F.). The reaction mixture was maintained at this temperature together with stirring and nitrogen blowing until the evolution of ammonia ceased (about 12 hours). The reactor was cooled to 50°C. (122°F.) and 400 mls. of heptane and 30 grams of inert amorphous silica filter aid were added. The mixture was cooled to 10°C. (50°F.), and filtered through filter aid. The filtrate was concentrated at 155°–160°C/20–30 mm Hg. for 1 hour and at 155°–160°C./2–4 mm Hg. for 1 hour resulting in a residue product in the form of a brown viscous oil which was identified as Primene JM-T ammonium thiocyanate. The recovered Primene JM-T ammonium thiocyanate was heated to 110°C. and air was passed therethrough at a rate of 10 liters per hour for a period of 16 hours. Analysis of the Primene JM-T ammonium thiocyanate before and after air blowing was undertaken and the following found:

TABLE I

| Product | Wt. % N | Wt. % S | Neut. No. |
|---|---|---|---|
| Thiocyanate Product | 7.2 | 7.9 | 142 |
| Airblown Thiocyanate | 7.1 | 8.3 | 143 |

TABLE I-continued

| Product | Wt. % N | Wt. % S | Neut. No. |
|---|---|---|---|
| Theory | 7.5 | 8.6 | 150 |

EXAMPLE VII

This example aids in illustrating one of the unexpected aspects of employing an oxygen containing gas as a puring gas in the procedure of the invention. The following analysis indicates that the products from the procedure of the invention and those prepared by comparative procedure gives essentially the same product analysis in respect to infrared and ultraviolet light spectra, neutralization number, sulfur and nitrogen content. Therefore, the difference in load-carrying capacity between the representative products and comparative product does not appear attributable to a difference based on this type product analaysis.

The Example I procedure was repeated twice and the comparative Example IV procedure once. The final product was analyzed for nitrogen content, sulfur, Neut. No., infrared and ultraviolet analysis and the following was found:

TABLE II

| Product | Procedure | Wt. % N | Wt. % S | Neut. No. |
|---|---|---|---|---|
| I | Ex. I | 7.8 | 8.5 | 146 |
| I | Ex. I | 7.7 | 8.8 | 149 |
| IV | Ex. IV | 7.6 | 8.6 | 148 |
| Theory | — | 7.5 | 8.6 | 150 |

EXAMPLE VIII

This example illustrates the substantial enhancement of load-carrying ability which the method of the invention imparts to the alkyl ammonium thiocyanate product. In addition, the example illustrates representative compositions of the invention containing the alkyl ammonium thiocyanate of enhanced load-carrying properties prepared by the method of the invention.

Oil compositions respectively containing the representative products of Examples I and II and the comparative products of Examples IV, V and VI had their load-carrying properties measured by the Ryder Gear Test (Federal Test Method 6508). In this test the lubricant is employed to lubricate two spur gears in a Pratt & Whitney Gear and Lubricant Tester. The tester is operated at a gear speed of 10,000 rpm using an oil inlet temperature of 165°F. The load in the gear is increased in increments of 5 psi until 22.5% of the total two face area on the driving gear has been scuffed, the load applied in the Ryder Gear Test being considered the scuff load. The tooth load is then calculated in lbs. inch (ppi) of tooth width. The greater the ppi the greater load-carrying ability of the test formulation.

The formulations tested are as follows:

TABLE III

| Ingredients | Weight % A | B | C | D | E |
|---|---|---|---|---|---|
| Pentaerythritol Tetraester of mixture of $C_5$—$C_9$ alkanoic acids | 95.3 | 95.33 | 95.3 | 95.33 | 95.3 |
| p,p'di-tert.octyl diphenylamine | 1 | 1 | 1 | 1 | 1 |
| N-(4-cumylphenyl)-6-cumyl-2-naphthyl | 1.5 | 1.5 | 1.5 | 1.5 | 1.5 |

TABLE III-continued

| Ingredients | A | B | C | D | E |
|---|---|---|---|---|---|
| | Weight % | | | | |
| amine | | | | | |
| Tricresylphosphate | 2 | 2 | 2 | 2 | 2 |
| Quinizarin | 0.1 | 0.1 | 0.1 | 0.1 | 0.1 |
| Methylsilicone polymer | 50 ppm | 50 ppm | 50 ppm | 50 ppm | 50 ppm |
| Example I JM-T Salt | 0.1 | — | — | — | — |
| Example II 81-R Salt | — | 0.07 | — | — | — |
| Example IV JM-T Salt | — | — | 0.10 | — | — |
| Example V 81-R Salt | — | — | — | 0.07 | — |
| Example VI JM-T Salt | — | — | — | — | 0.10 |

The above formulations were tested in the Ryder Gear Test with the following results:

TABLE IV

| Composition | Salt prep. | Ryder Gear Rating (ppi) |
|---|---|---|
| A | Air | 3865* |
| B | Air | 3830 |
| C | $N_2$ | 3340* |
| D | $N_2$ | 3285 |
| E | Air** | 3175 |

*2 Run Average
**Air blowing final product only

As can be seen from the foregoing table, representative compositions A and B prepared by the representative method when compared to comparative compositions C, D and E prepared by comparative methods have load-carrying capacities about 20% greater than the comparative compositions.

We claim:

1. A method of preparing an alkyl ammonium thiocyanate of enhanced load-carrying properties in synthetic ester lubricating oils comprising forming a mixture of a thiocyanate reactant of the formula MSCN where M is a member selected from the group consisting of ammonium and monoalkyl ammonium of from 2 to 7 carbons and an alkyl amine from 6 to 30 carbons of the formula:

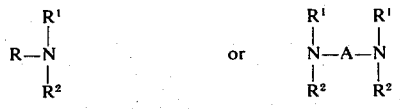

where A is alkylene of from 2 to 6 carbons, R is alkyl of from 6 to 30 carbons, $R^1$ and $R^2$ are hydrogen or alkyl of from 1 to 10 carbons utilizing a ratio of equivalent weight of said amine to mole of said thiocyanate reactant of between about 1:1.2 and 0.9:1, heating the resultant mixture to a temperature of between about 90° and 130°C. while continuously introducing into said mixture as free oxygen containing gas at a gas rate of between about 40 and 200 volumes gas per hour per volume said mixture and maintaining said temperature and gas introduction until between about 5 and 0.2 mole oxygen per equivalent weight of initial amine has been introduced.

2. A method in accordance with claim 1 wherein said thiocyanate reactant is ammonium thiocyanate and said amine is a mixture of tertiary alkyl primary monoamines in which the tertiary alkyl moiety is of 11 to 14 carbons.

3. A method in accordance with claim 1 wherein said thiocyanate reactant is ammonium thiocyanate and said alkyl amine is a mixture of tertiary monoalkyl primary amines in which the tertiary alkyl moiety is of 18 to 24 carbons.

* * * * *